US006564762B2

(12) United States Patent
Dow

(10) Patent No.: US 6,564,762 B2
(45) Date of Patent: May 20, 2003

(54) GEAR TRAIN CRANKSHAFT

(76) Inventor: Glendal R. Dow, 1320 Hardisty, Bedford, TX (US) 76021

( * ) Notice: Subject to any disclaimer, the term of this patent is extended or adjusted under 35 U.S.C. 154(b) by 0 days.

(21) Appl. No.: 09/842,575

(22) Filed: Apr. 26, 2001

(65) Prior Publication Data

US 2001/0029922 A1 Oct. 18, 2001

Related U.S. Application Data

(60) Provisional application No. 60/200,430, filed on Apr. 28, 2000.

(51) Int. Cl.[7] ..... F02B 75/04

(52) U.S. Cl. ..... 123/78 F; 123/197.4; 74/52

(58) Field of Search ..... 123/197.1, 197.4, 123/48 B, 78 F; 74/52

(56) References Cited

U.S. PATENT DOCUMENTS 1,210,861 A * 1/1917 Sitney ..... 74/52
3,756,206 A 9/1973 Gommel ..... 123/317
4,860,702 A * 8/1989 Doundoulakis ..... 123/78 F
4,970,995 A 11/1990 Parsons ..... 123/54.2
5,537,957 A 7/1996 Gutkin ..... 123/197.1
5,908,014 A * 6/1999 Leithinger ..... 123/48 B

* cited by examiner

*Primary Examiner*—Noah P. Kamen
(74) *Attorney, Agent, or Firm*—Bracewell & Patterson, L.L.P.

(57) ABSTRACT

A drive mechanism can be utilized either as a pump or an engine. The device has a piston and cylinder. The piston has a rod that connects with a power gear via a link pin that joins the power gear at a point offset from the power gear shaft. The power gear orbits about a rim gear. A crankshaft gear mounted to a primary shaft is rotated by the orbital movement of the power gear. The rim gear and power gear can be placed in position to constrain the rod to move along the axis of the cylinder. Also, the rim gear can be rotated to a different position so as to cause the end of the rod to orbit with the power gear. This position can be selected to change the stroke length and thus the torque.

5 Claims, 6 Drawing Sheets

Fig. 11
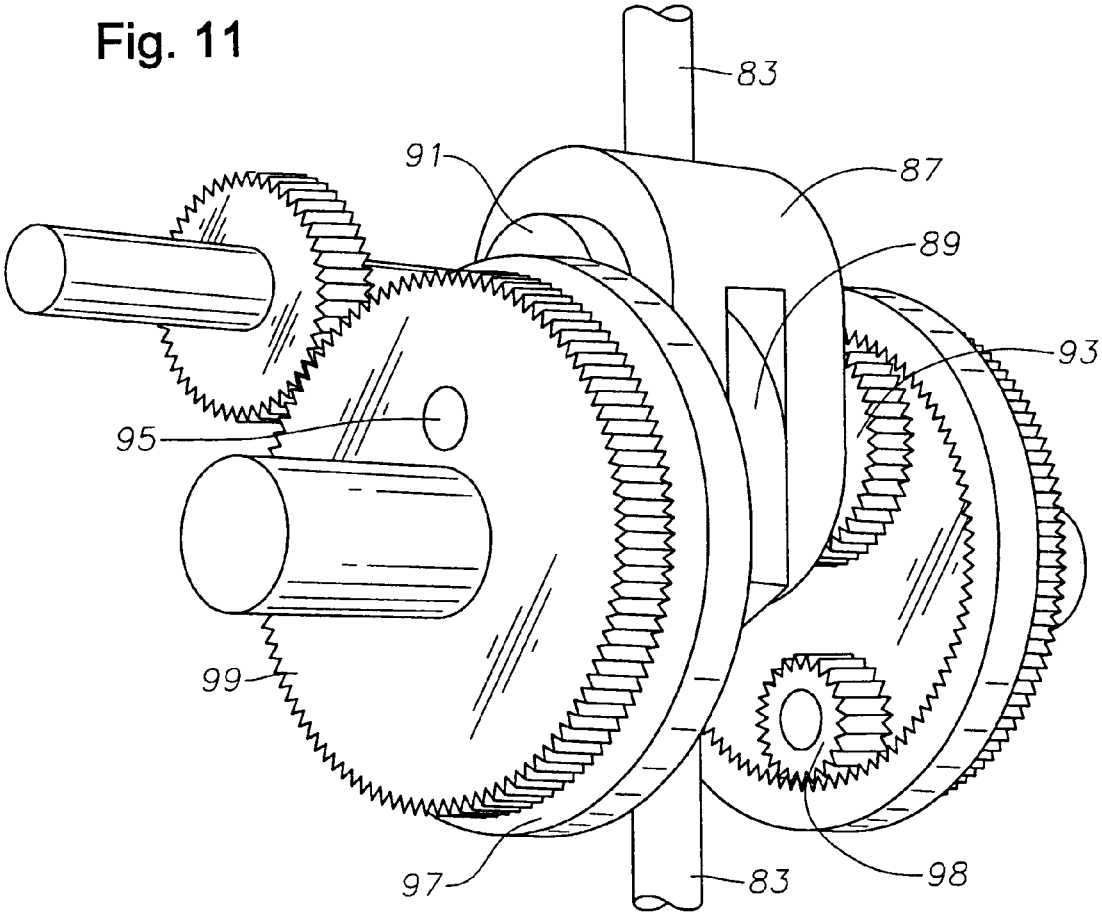
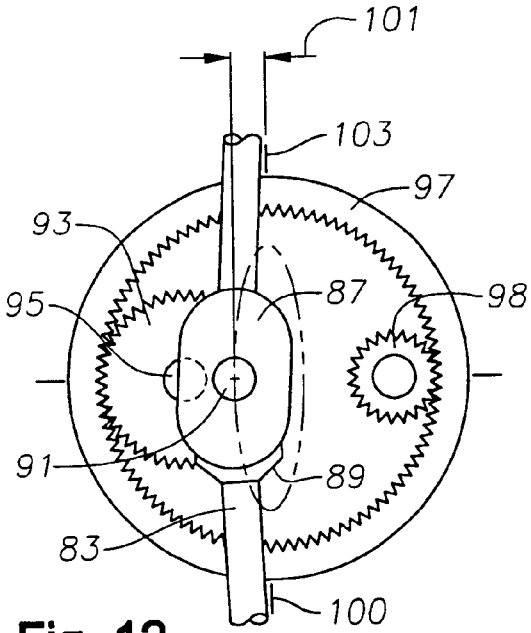
Fig. 12

GEAR TRAIN CRANKSHAFT

This application is based on Provisional Application Serial No. 60/200,430 filed Apr. 28, 2000.

FIELD OF THE INVENTION

This invention relates in general to a device for translating linear reciprocating motion to rotary motion, and vice versa, and particularly to an engine or a pump employing a gear driven crankshaft.

BACKGROUND OF THE INVENTION

Internal combustion engines normally have at least one piston that is reciprocated within a cylinder. A rod connects the piston to a crankshaft which has offset portions that cause the end of the rod to orbit about an axis of the crankshaft. The rotation of the crankshaft drives a transmission. Piston pumps operate in a similar manner, using a rotatably driven crankshaft to drive the pistons. While crankshafts of this nature are certainly workable, there are limitations. One limitation is that since the second end of the rod orbits, only one side of the cylinder can be utilized as a working fluid chamber. Also, the length of the stroke is fixed for a given crankshaft. Changing the length of the stroke will change the torque, however requires replacing the crankshaft.

SUMMARY OF THE INVENTION

The driver apparatus of this invention, whether utilized as an engine or pump, has a piston slidably carrying in a cylinder for stroking reciprocally along an axis of the cylinder. A piston rod connects to the piston and has a second end that connects to a power gear. The power gear is concentrically mounted to a power gear shaft and has a link pin connected between the second end of the piston rod and the power gear. The point of connection of the link pin is offset from the power gear axis so that as the second end of the rod strokes, the power gear rotates.

The power gear engages teeth of a rim gear, which when held stationary, causes the power gear to orbit about the rim gear as the power gear rotates. A crankshaft gear is concentrically mounted to a primary shaft for rotation with it. The power gear shaft engages the crankshaft gear at a point offset from the primary shaft so that as the primary gear orbits about the rim gear, the crankshaft gear and the primary shaft will rotate.

The pitch diameter of the rim gear is a multiple of the pitch diameter of the power gear. By positioning the link pin axis on the pitch diameter of the power gear, the second end of the rod can be constrained to travel the along of the axis of the cylinder. The cylinder can thus have a second head with a sealed aperture through which the rod sealingly passes. The second head defines a second working chamber, which can be used to pump a liquid, compress gas, or serve as another combustion chamber. For example, the second working fluid chamber can be used to pre-compress a fuel and air mixture in an accumulator, then on a subsequent stroke, deliver the mixture to the first working fluid chamber for combustion.

If the axis of the link pin is positioned at a point between the pitch diameter of the rim gear and the axis of the rim gear, it will cause the second rod end to rotate about an elliptical path. The elliptical path can be designed to achieve the desired rate of speed of the piston within the cylinder at various points along the stroke.

The rim gear can be rotated from a maximum stroke position to a minimum stroke position. In the maximum stroke position, the link pin located is on the cylinder axis, and the rod is aligned with the cylinder axis, while the link pin is closest to and farthest from the center point or axis of the rim gear. In the minimum stroke position, the rim gear is rotated 90° from the maximum stroke position. This places the power gear farthest from the center point of the rim gear when it is located at 90° and 270° positions on the rim gear relative to the cylinder axis. Shifting the rim gear toward the minimum stroke position reduces the length of the stroke but increases the torque.

The rotation of the rim gear can be performed manually or by a separate actuator. Also, the rim gear may be allowed to move in response to a pressure increase when the device operates as a pump or compressor. As the pressure increases, the rim gear will naturally rotate so as to decrease the stroke length and increase the torque. A spring or other type of actuator can be connected to the rim gear to urge it toward the maximum stroke position.

BRIEF DESCRIPTION OF THE DRAWINGS

FIG. 11 is an enlarged perspective view of a portion of the gear train crank shaft of FIG. 10.

FIG. 12 is a side elevational view of the gear train crank shaft of FIG. 10, shown with the primary crank shaft gear removed.

DETAILED DESCRIPTION OF THE INVENTION

Figure 1:
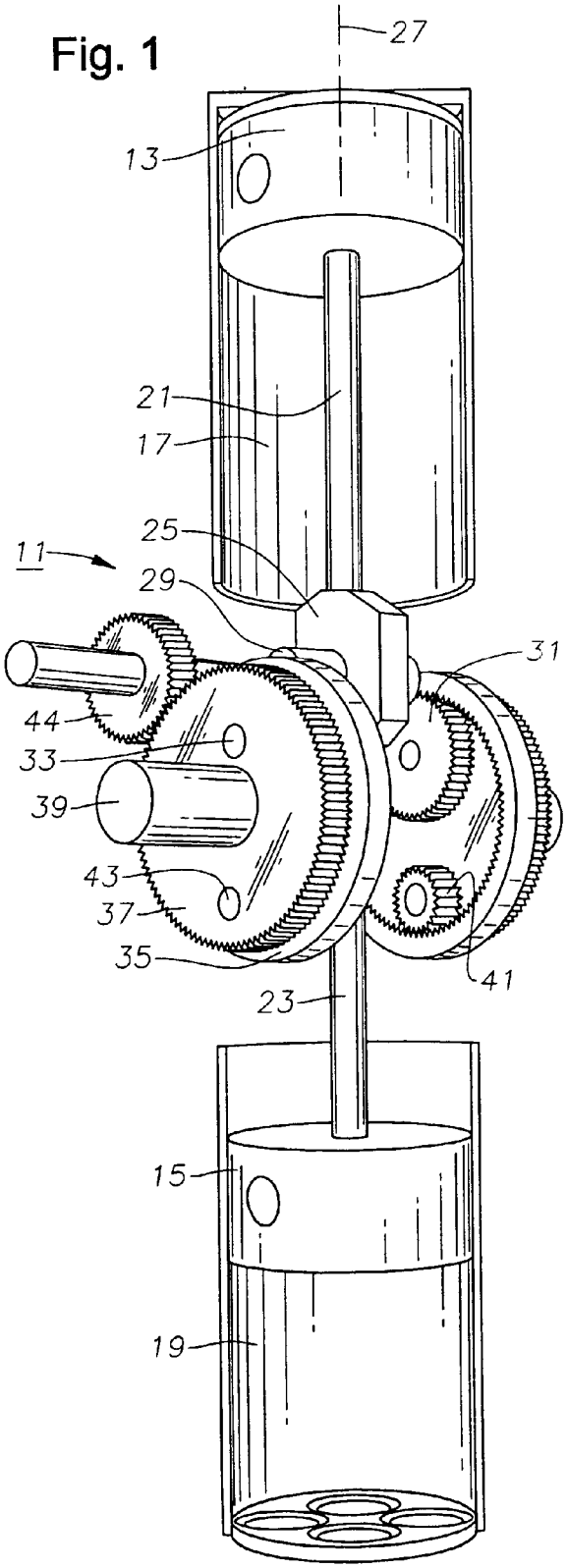
FIG. 1 is a schematic perspective view illustrating a gear train crank shaft constructed in accordance with this invention.
Figure 2:
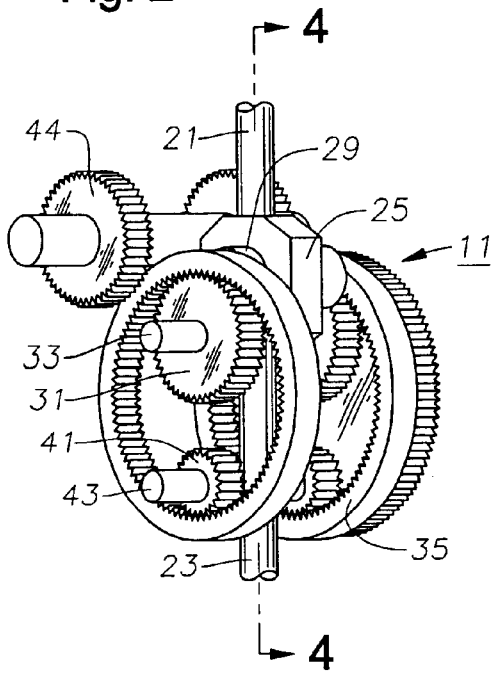
FIG. 2 is a perspective view of the gear train crank shaft of FIG. 1, with a primary crank shaft gear removed for clarity.
Figure 3:
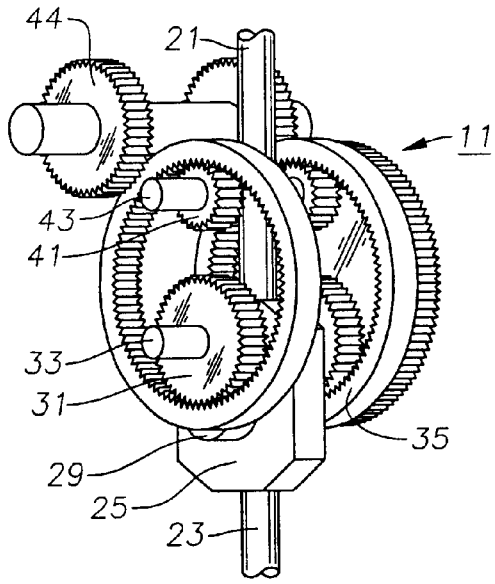
FIG. 3 is a view of the gear train crank shaft as shown in FIG. 2, but showing it in a different position.
Figure 4:
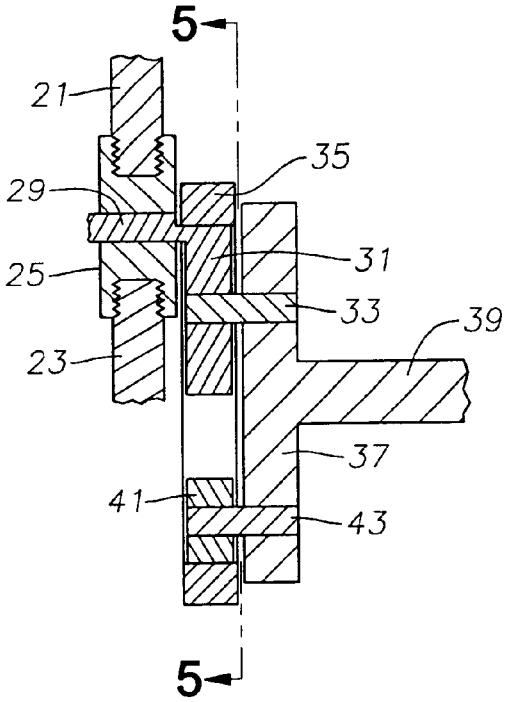
FIG. 4 is a partial sectional view of one-half of the gear train crank shaft of FIG. 1, taken along the line 4—4 of FIG. 2.

Referring to FIG. 1, gear train crank shaft assembly 11 converts reciprocating movement of pistons 13, 15 into rotary motion and vice versa. Pistons 13, 15 are located within cylinders 17, 19. Pistons 13, 15 have rods 21, 23 that extend inward toward each other. In the embodiments of FIGS. 1–9, rods 21, 23 are rigidly connected together by a link 25. Link 25 maintains rods 21, 23 along longitudinal axis 27 of both cylinders 17, 19. As pistons 13, 15 move inward and outward relative to crank shaft assembly 11, rods 21, 23 remain concentric with cylinder axis 27.

Figure 5:
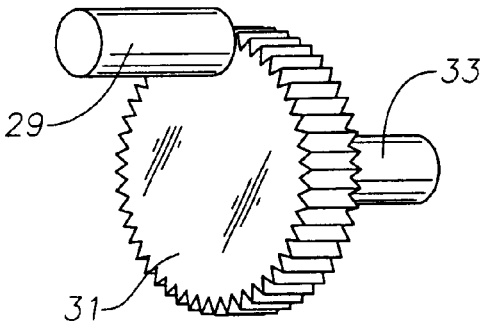
FIG. 5 is an enlarged view of the power gear employed with the gear train crank shaft of FIG. 1.

Link 25 is a solid, rigid member that has a pin 29 protruding from it on each side perpendicular to axis 27. Pins 29 are rotatable relative to link 25. As shown in FIG. 5, each pin 29 is welded or otherwise rigidly attached to a power gear 31. In this embodiment, the axis of each pin 29 is tangent to the pitch diameter of each power gear 31. The pitch diameter is measured between the outer diameter of the teeth and the root diameter of the teeth of power gear 31. Note that there are two power gears 31, one on each side of link 25 for symmetry. Power gear 31 is mounted to a power gear shaft 33 that is located on its axis of rotation.

Figure 6:
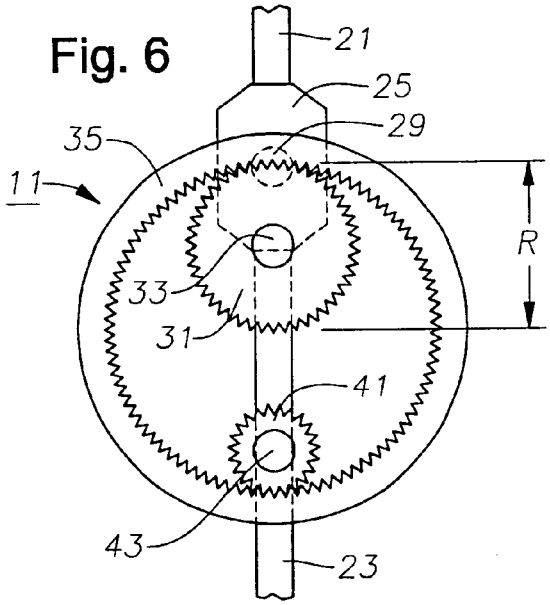
FIG. 6 is a side elevational view of the gear train crank shaft of FIG. 1, with the primary crank shaft gear removed, similar to FIG. 2.
Figure 7:
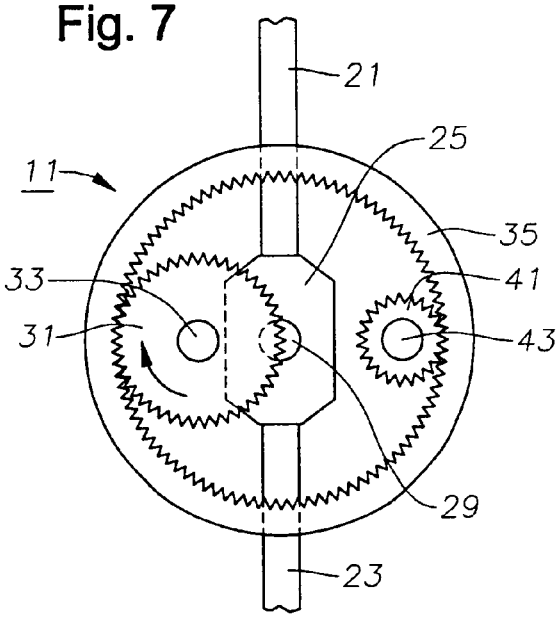
FIG. 7 is a side elevational view of the gear train crank shaft of FIG. 1, shown as in FIG. 6, but in a different position.

Each power gear 31 has teeth on its periphery that mesh with teeth on an internal rim gear 35, shown in FIGS. 1–4, 6 and 7. Rim gear 35 is a ring having teeth located on its inner diameter. The axis or center point of rim gear 35 is located on axis 27 of cylinder 17. Referring to FIG. 6, the number of teeth on internal rim gear 35 is a multiple of the number of teeth on power gear 31. Preferably, the number of teeth of rim gear 35 is twice that of power gear 31, and the pitch diameter of power gear 31 is one-half that of rim gear 35. During operation of the first embodiment, rim gear 35 is held stationary while power gear 31 rotates. The two-to-one ratio results in power gear 31 rotating one full revolution as it orbits one single time around the teeth of rim gear 35. This is due to the radius R (FIG. 6) of power gear 31 being one-half the inner diameter of rim gear 35. As indicated in FIG. 7, when power gear 31 has rotated one-fourth of a turn clockwise about the axis of shaft 33, it will orbit counter-clockwise one-fourth of the distance around rim gear 35, to a 270 degree position. During the one-fourth clockwise rotation, pin 29 will rotate to a 90 degree position, pulling rods 21, 23 downward to a position wherein pin 29 is concentric with the axis of rim gear 35. Continued clockwise rotation of power gear 31 about the axis of shaft 33 causes it to orbit completely around rim gear 35, stroking rods 21, 23 in unison from an upper position shown in FIGS. 2 and 6, to a lower position shown in FIG. 3 and back to the upper position shown in FIGS. 2 and 6. The terms "upper" and "lower" are used only for reference herein and not in a limiting manner.

Each shaft 33 locates rotatably within a hole in a primary crank shaft gear 37 (FIG. 1). Shaft 33 is eccentrically located in each primary crank shaft gear 37, offset from the axis of rotation. The orbital movement of shafts 33 cause primary crank shaft gears 37 to rotate while power gears 31 and shafts 33 orbit around rim gears 35. At least one of the primary crank shaft gears 37 has a primary crank shaft 39 that rotates for supplying power, such as driving a transmission of a vehicle. Alternately, when used as a pump, primary crank shaft 39 would be driven to causes reciprocation of pistons 13.

An idler gear 41 is located 180 degrees from each of the power gears 31. Each idler gear 41 has a concentric shaft 43 that rotatably engages one of the primary crank shaft gears 37 180 degrees from shaft 33. A driven gear 44 is employed for driving other components of the engine, such as a cam shaft, and for stabilizing the primary crank shaft gears 37. Driven gears 44 engage teeth on the exteriors of primary crank shaft gears 37.

In the operation of the embodiment as shown in FIGS. 1–9, the assembly could be either a reciprocating internal combustion engine or it could be a pump. In the event it is an engine, valves would supply fuel to the closed outer ends of cylinders 17, 19 at the proper point in the stroke. Piston 13 moves outward toward the outer or upper end of its cylinder 17 while piston 15 moves inward, away from the outer end of its cylinder 19. The energy due to combustion in one of the cylinders 17, 19 pushes pistons 13, 15 in unison in one direction. Pin 29 causes power gear 31 to rotate around stationary rim gear 35. The ratio of power gear 31 to rim gear 35 and the positioning of pin 29 on the pitch diameter of power gear 31 allow rods 21, 23 to be maintained on axis 27 during each stroke. The orbital movement of power gear 31 causes primary crank shaft gear 37 to rotate, driving its shaft 39.

If operated as a pump, shaft 39 will be driven by a power source, causing primary crank shaft gear 37 to rotate. This results in power gear 31 orbiting around stationary internal rim gear 35. This causes pistons 13, 15 to stroke in unison with each other. Valves (not shown) will be located in the outer ends of cylinders 17, 19 for drawing fluid in and pumping it out.

Figure 8:
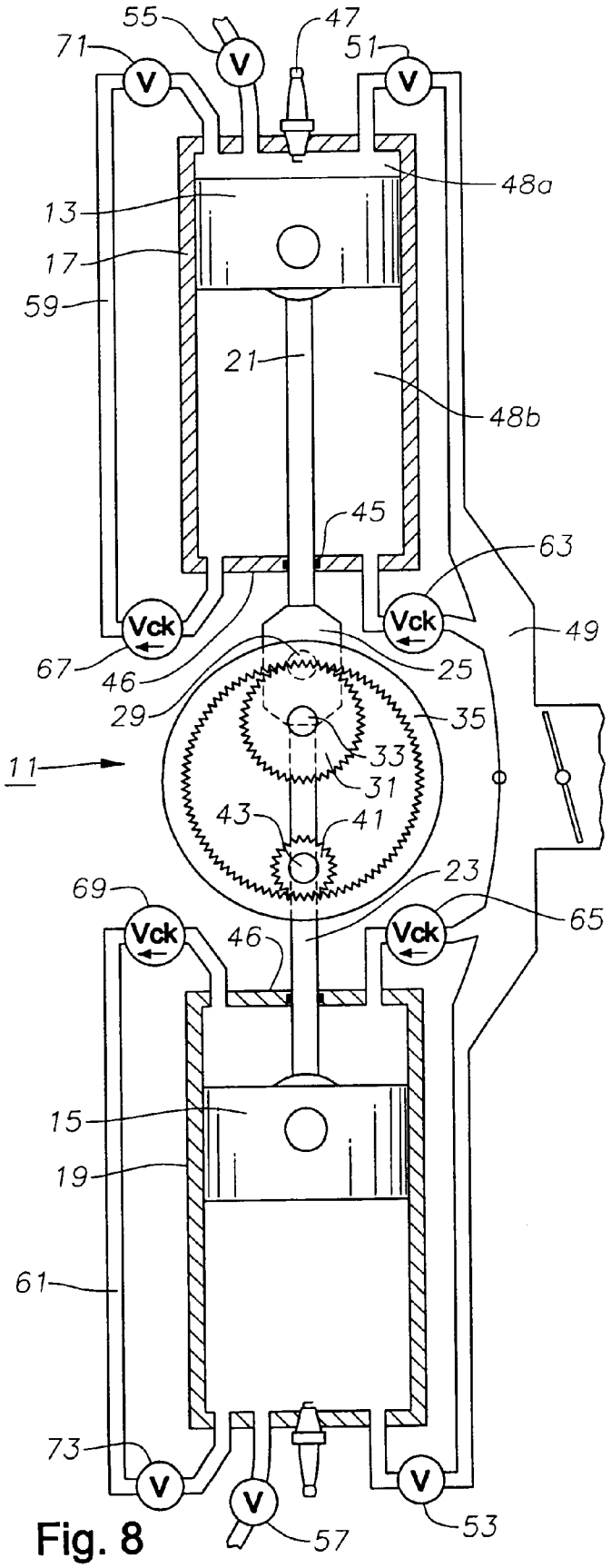
FIG. 8 is a side elevational, schematic view of the gear train crank shaft assembly of FIG. 1, shown connected to a manifold for supercharging.

FIG. 8 shows the assembly of FIG. 1, with additional components added that may be utilized for supercharging an internal combustion engine. Since rods 21, 23 are always concentric with axis 27, the inner ends or inner heads 46 of cylinders 17, 19 may be closed, with each having a hole for the passage of one of the rods 21, 23. A seal 45 is located at the hole in each inner end 46 for slidingly sealing on one of the rods 21, 23. The outer ends of cylinders 17, 19 will also be closed, resulting in a separate working fluid chamber **48*a*, 48*b* on each side of each piston 13. A spark plug 47 is located on an outer end of each cylinder 17, 19 for causing combustion in the outer working fluid chamber 48*a*. A manifold 49 is connected to a source of fluid for drawing in fuel into the outer working fluid chamber 48*a* of each cylinder 17, 19 during an intake stroke. Valves 51, 53 connect manifold 49 to the outer working fluid chambers 48*a* of cylinder 17, 19. Valves 51, 53 are timed by a cam shaft (not shown) so as to open to allow fuel to enter at the proper time during the stroke. Valve 51 will be open while valve 53** is closed and visa versa.

Each cylinder 17, 19 also has an exhaust valve 55, 57, respectively, that exhausts products of combustion from the outer working fluid chamber **48*a* of each cylinder 17, 19. Valves 55, 57 are timed by a cam shaft so as to open and close during the proper times of the stroke. Valve 55 is open for exhausting components while valve 57 would be closed, because piston 15 will be in an inner position while piston 13 is in an outer position. The assembly of FIG. 8 also has an accumulator 59 for cylinder 17 and another accumulator 61 for cylinder 19. Each accumulator 59, 61 is an exterior plenum that will hold a compressed fuel mixture, the fuel mixture being compressed during inward movement of each piston 13, 15. Alternately, if fuel injection directly into outer working fluid chambers 48*a* of cylinders 17, 19 is used, each accumulator 59, 61 will hold compressed air, compressed by the stoking of pistons 13, 15**.

A reed valve or check valve 63 is located in a passage connecting manifold 49 to the inner working fluid chamber **48*b* of cylinder 17. A reed valve or check valve 65 is located in a passage connecting manifold 49 to the inner working fluid chamber 48*b* of cylinder 19. When piston 13 moves away from inner end 46, fuel flows into cylinder 17 on the inner side of piston 13. Similarly, when piston 15 moves away from inner end 46, fuel will flow through check valve 65 into inner working fluid chamber 48***b* on the inner side of its piston 15. Check valves 63, 65 prevent any flow from cylinders 17, 19 back into manifold 49. A check valve 67 connects to inner end 46 of cylinder 17 and to one end of accumulator 59. Check valve 67 allows flow from cylinder 17 when piston 13 is moving toward inner end 46. Similarly, a check valve 69 connects to the inner end 46 of cylinder 19. Check valve 69 allows flow out of cylinder 19 when its piston 15 is moving toward inner end 46. Check valves 67, 69 prevent any flow from accumulators 59, 61 back into cylinders 17, 19. The other ends of accumulators 59, 61 are connected to valves 71, 73, respectively. Valve 71 is a timed valve that connects to outer working fluid chamber 48*a* of cylinder 17. Valve 73 is a timed valve connected to outer working fluid chamber 48*a* of cylinder 19.

In the operation of the embodiment of FIG. 8, assume that spark plug 47 has just sparked, igniting a fuel mixture contained in outer working fluid chamber 48*a* of cylinder 17. All three valves 51, 55 and 71 will be closed. A fuel mixture will have been previously drawn into inner working fluid chamber 48*b* of cylinder 17 through check valve 63. Consequently, as piston 13 starts moving inward toward inner end 46 due to combustion, it will force the fuel mixture through check valve 67 into accumulator 59. Valve 71 will be closed during the inward stroke of piston 13. Once it reaches the downstroke position, near inner end 46, piston 13 starts moving back outward. At this point, exhaust valve 55 will be open for discharging exhaust. Also, as piston 13 moves back outward, it draws another mixture of fuel into inner working fluid chamber 48*b* of cylinder 17 through check valve 63. Valves 51 and 71 will still remain closed. Piston 13 purges cylinder 17 of exhaust and moves back downward toward inner end 46. At this time, valve 51 opens to cause another fuel mixture to flow into outer working fluid chamber 48*a* of cylinder 17. Also during the later part of this downward movement toward inner end 46, the fuel mixture on the inner side of piston 13 will be forced through check valve 67 into accumulator 59 and valve 71 will open to cause the compressed fuel mixture in accumulator 59 to flow into outer working fluid chamber 48*a* of cylinder 17. Valve 71 will open early in the upstroke of piston 13. As piston 13 moves back outward, valves 51, 71 will close, further compressing the fuel mixture. Spark plug 47 will ignite the mixture to repeat the cycle. Piston 15 operates 180 degrees out of phase with piston 13, but otherwise operates the same. It compresses a mixture of fuel and gas in cylinder 19 on the inner end of its piston 15, forces the mixture into accumulator 61, then pushes the mixture through valve 73 for detonation with fuel flowing through valve 53.

Figure 9:
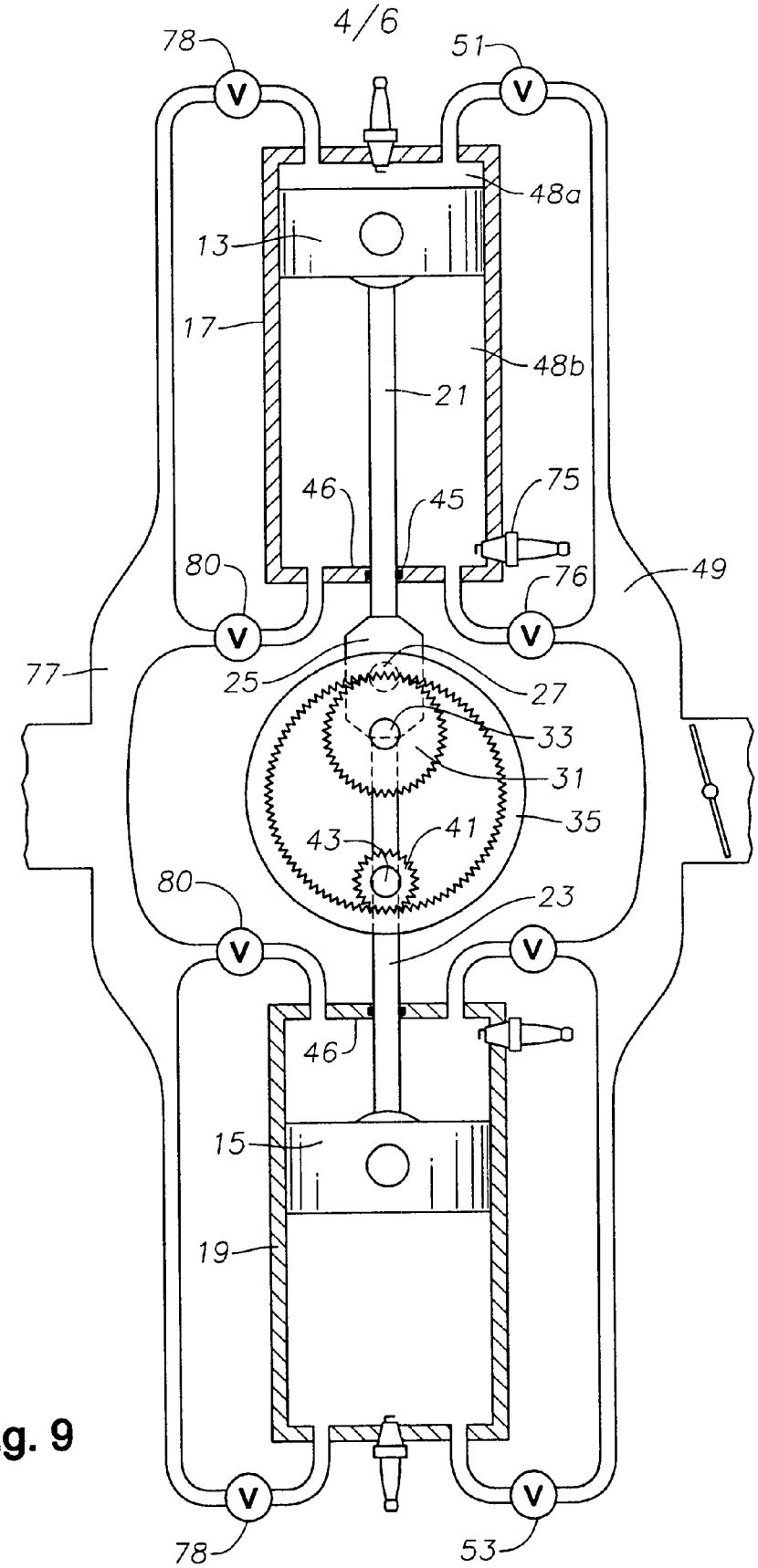
FIG. 9 is a side elevational view of the gear train crank shaft of FIG. 1, shown connected to manifolds for firing on both sides of the pistons.

FIG. 9 illustrates the assembly of FIG. 1 connected for combustion on both inward and outward strokes of pistons 13, 15. Elements that are the same as in FIG. 8 use the same numerals. In FIG. 9, a spark plug 75 is located near inner end 46 of each cylinder 17, 19. Manifold 49 is connected to the inner end 46 of each cylinder 17, 19 by means of a timed valve 76, rather than check valves 63, 65 (FIG. 8). An exhaust manifold 77 is connected to the outer end of each cylinder 17, 19 by means of a timed valve 78. Exhaust manifold 77 is connected to the inner end 46 of each cylinder 17, 19 by means of a timed exhaust valve 80.

In the operation of the embodiment of FIG. 9, piston 13 is in an outer position, wherein spark plug 47 will be igniting a fuel mixture drawn into and compressed in the outer working fluid chamber 48*a* of cylinder 17. Valves 51, 78 will be closed. The ignition of the fuel mixture causes piston 13 to move inward toward inner end 46. Valve 80 will be open for discharging exhaust products contained in inner working fluid chamber 48*b* of cylinder 17 from a previous ignition. After reaching the inner end of the stroke, piston 13 moves back toward the outer end of cylinder 17. Intake valve 51 will be closed and exhaust valve 78 will be open for discharging exhaust products from outer working fluid chamber 48*a* of cylinder 17. Also, while moving outward, valve 76 will be open and valve 80 closed to allow fuel to flow into inner working fluid chamber 48*b* of cylinder 17. Piston 13 moves back inward then, with both valves 76 and 80 closed for compressing the fuel mixture previously drawn in. When at the inward end of the stroke, spark plug 75 ignites the mixture to drive piston 13 back in the outward direction. While piston 13 was compressing the fuel mixture in inner working fluid chamber 48*b* of cylinder 17, a fuel mixture would be flowing through valve 51 into outer working fluid chamber 48*a* of cylinder 17. Intake valve 53, as well as valves 76, 80 and 78 associated with cylinder 19, will operate in the same manner but out of phase with those associated with cylinder 17. Piston 15 will be moving outward while piston 13 moves inward and visa versa.

Figure 10:
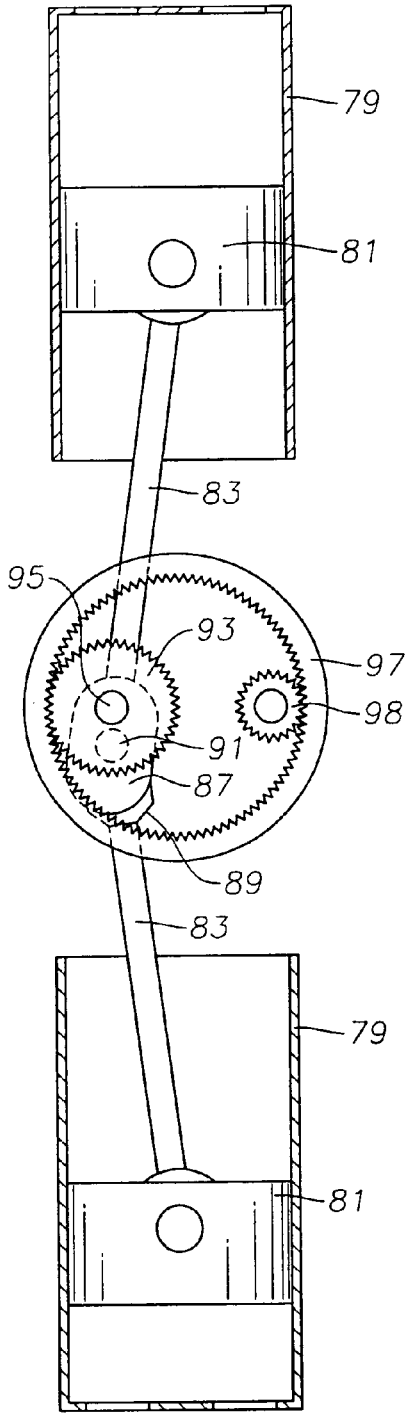
FIG. 10 is a side elevational view of an alternate embodiment of the gear train crank shaft of FIG. 1.

FIGS. 10–13 illustrate an embodiment wherein the piston rods do not remain in a straight line on the axis, and illustrate varying the stroke. Referring to FIG. 10, there are two pistons 81, each having an inward extending rod 83. One of the rods 83 has a clevis 87 on its end, as shown in FIG. 11. The other rod 83 has a plate 89 that fits between the two portions of clevis 87. Plate 89 is secured by pins to clevis 87 and is free to rotate relative to clevis 87. Link pin 91 is rigidly formed with power gear 93 offset from the axis of rotation of power gear 93. Power gear 93 has an output shaft 95. Power gear 93 has external teeth that engage the teeth of an internal rim gear 97, in the same manner as in connection with the first embodiment. Shaft 95 is rotatably received within a hole in a primary crank shaft gear 99. Shaft 95 is eccentric so as to cause rotation of gear 99 as power gear 93 orbits around internal rim gear 97. An idler gear 98 is located opposite power gear 93.

Figure 13:
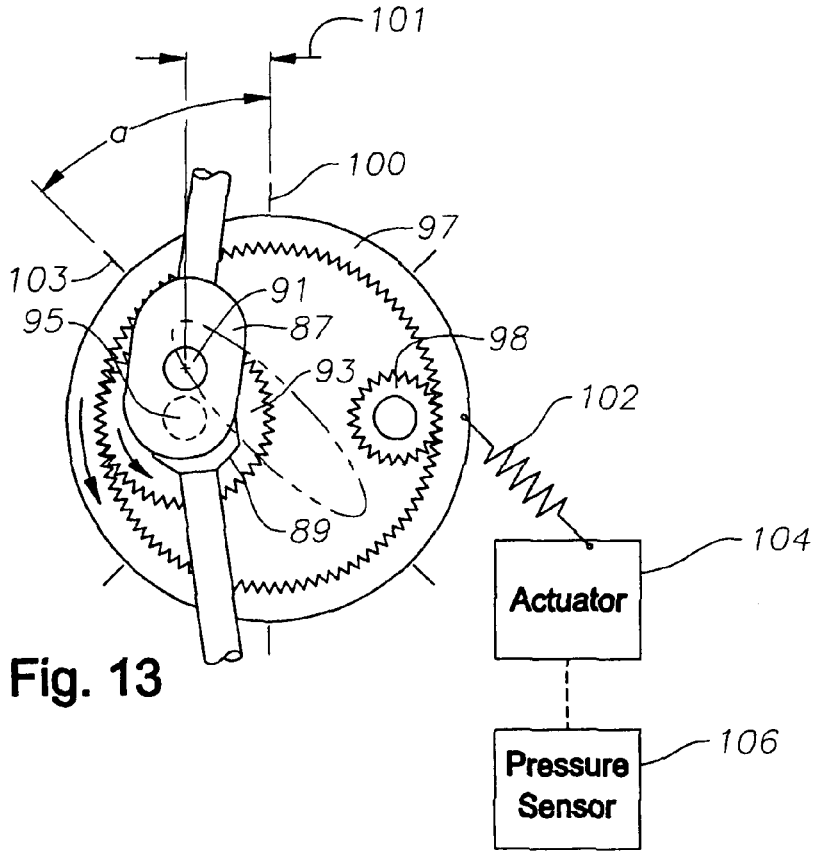
FIG. 13 is a side elevational view of the gear train crank shaft of FIG. 12, but shown with the rim gear repositioned, and shown with a spring and actuator attached.

Pin 91 is eccentric to power gear 93, however, the axis of link pin 91 is not precisely on the pitch diameter of power gear 93, as in the first embodiment. Rather the distance from link pin 91 to the pitch diameter is less than the radius of power gear 93 to the pitch diameter. If the center of link pin 91 is not tangent to the pitch diameter of power gear 93, an elliptical crankshaft rod end travel will result at clevis 87. The dotted lines in FIGS. 12 and 13 illustrate the elliptical path taken by link pin 91 as power gear 93 rotates about rim gear 97. Since the path is elliptical, rather than a straight line as in the embodiments of FIGS. 1–10, the linear speed of reciprocation of the pistons (not shown) will vary at different points along the stroke. The elliptical path can be dimensioned to achieve desired speeds at different points along the stroke. The dimensions of the elliptical path will change depending on the distance that link pin 91 is from the pitch diameter of power gear 93.

The elliptical travel of link pin 91 also changes the length of the stroke and the torque from the embodiment of FIGS. 1–9, which restrain the piston rods 21 to traveling on the cylinder axis 27. In the position of FIG. 12, while power gear 93 is at the 270 degree position relative to cylinder axis 100, pin 95 will be offset from the cylinder axis 100 or center point of internal rim gear 97 by a distance 101. Compare this to the first embodiment shown in FIG. 7, where pin 29 is located on the common longitudinal axis of rods 21, 23 at this position, thus having a distance 101 of zero. The distance 101 increases the torque supplied by pistons 81 (FIG. 10), but shortens the stroke.

FIGS. 12 and 13 also illustrate another change to the device that causes the length of the stroke to be varied and thus the torque of the device. During operation, rim gear 97 may be stationary, however, it can be adjusted prior to operation by rotating it, then locking it in place. In FIG. 12, rim gear 97 is in a maximum stroke position. In the maximum stroke position, the axis of link pin 95 will be at its farthest position from the center point of rim gear 97 while simultaneously passing through axis 100 of the cylinder (not shown). This will occur twice per revolution, once at the zero degree position and once at the 180 degree position on rim gear 97 relative to axis 100. While at the zero and 180 degree positions, rod 103 will coincide with axis 100, also. The maximum stroke position results in the least amount of torque but the longest distance of travel of the piston. There will still be an offset 101 at the 270 degree position because of the elliptical path of link pin 91, but the stroke length is maximum for the particular location of link pin 91 on power gear 93.

Rotating rim gear 97 incrementally to a new position, as shown in FIG. 13, will cause the axis of link pin 91 to be at a different point rotationally on rim gear 97 while link pin 91 is at its position farthest from the center point of rim gear 97. As shown in FIG. 13, index point 103 has moved an angle a from the 0 degree position to about 320 degrees. This results in connecting rods 83 being at a greater angle relative to each other than they would be in FIG. 12. This greater angle increases the offset distance 101 in FIG. 12 to the offset distance 101 shown in FIG. 13. The torque thus increases over that shown in FIG. 12, but the stroke will be shorter. If the embodiment of FIGS. 10–13 is operated as a pump, the adjustment of rim gear 97 allows the pump pressure and volume to be changed.

The embodiment of FIGS. 10–13 operates in the same manner as the first embodiment. The pistons 81 both move in unison with each other, with one of the piston 81 being on a upstroke toward the outer end, while the other piston 81 is on a downstroke, toward the inner end. Power is output via primary crankshaft gear 99. The embodiment of 10–13 can be utilized as a pump or an engine.

FIG. 13 also illustrates how varying the stroke can be utilized to change the stroke in response to the load. Rim gear 97 will be allowed to rotate during operation, but preferably is biased to the neutral or maximum stroke position of FIG. 12. As the pressure of the working fluid on the upper end of the cylinder (not shown) increases, rim gear 97 will naturally tend to rotate to a position with shorter length strokes but more torque. More torque is created by having more offset 101. One or more springs 102, shown schematically, may be incorporated with rim gear 97 to bias rim gear 97 toward the maximum stroke position. As mentioned, in the maximum stroke position, link pin 95 and rod 83 would be aligned with cylinder axis 100 while link pin 95 is at its maximum distance from the center point of rim 97. This also occurs when pin 95 is at its closest and its farthest position from the cylinder axis 100.

The tension of spring 102 can be set so that the device will pump at a constant pressure, but variable stroke. This might occur, for example, when pumping a liquid. On the other hand, while pumping a gas into a storage container, it is desirable to stop pumping when reaching a set pressure. Initially, the pump would operate with rim gear 97 at the maximum stroke position of FIG. 12 so as to initially pump maximum volumes of fluid. Because of little back pressure, the power requirement would not be significant, therefore higher torque is not needed. As the pressure increases, however, spring 102 and stops (not shown) would allow gear 97 to rotate up to 90° to increase the torque and decrease the stroke length. Consequently, a rather small motor or engine could drive a compressor to fairly high level of pressure and at a high level of efficiency.

The desired pressure could be set by sizing spring 102 to create the desired bias. Alternately, FIG. 13 shows an actuator 104 and a pressure sensor 106 for selecting a desired pressure. Pressure sensor 106 could be employed to actually sense the pressure and provide a signal to control actuator 104. Actuator 104 could be directly coupled gear 97 to change its rotational position, or it could be coupled to spring 102 to increase the spring tension. Actuator 104 could be simply a linear movable device that operates in response to different signals provided by pressure sensor 106.

Figure 14:
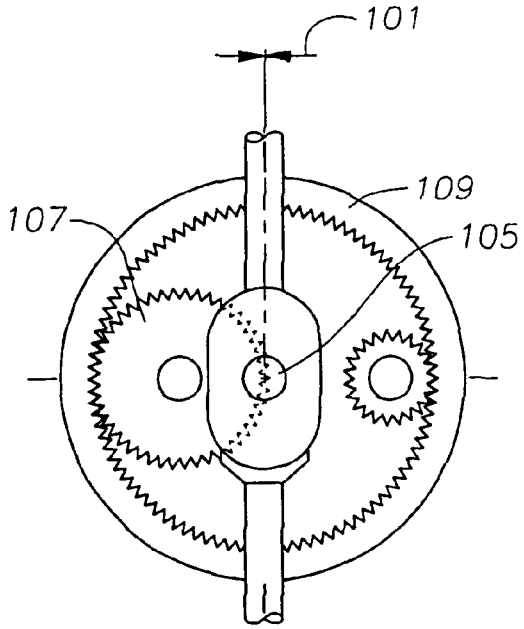
FIG. 14 is a side elevational view of another embodiment of a gear train crank shaft.
Figure 15:
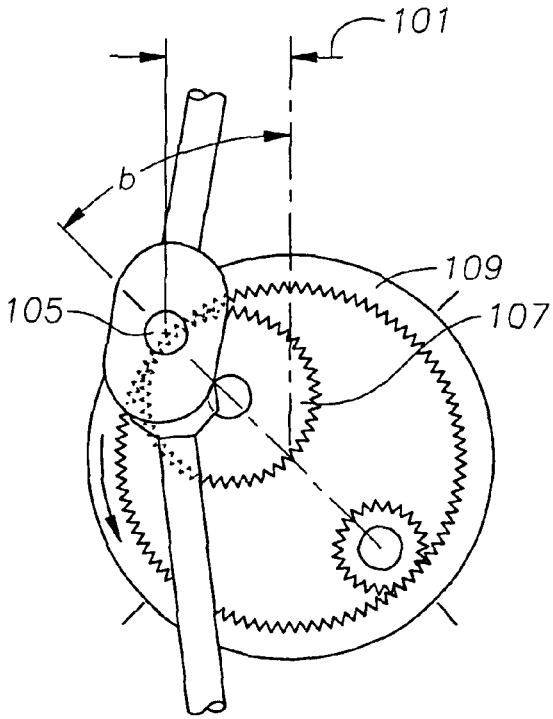
FIG. 15 is a side elevational view of the embodiment of FIG. 14, but shown with the rim gear repositioned.

The embodiment of FIGS. 14 and 15 illustrates changing the position of the rim gear, as the embodiment of FIGS. 11–13, however, link pin 105 is located on the pitch diameter of power gear 107, not positioned to create an elliptical path as shown in FIGS. 12 and 13. In FIG. 14, rim gear 109 is at the maximum stroke position. The axis of link pin 105 will be the farthest from the center point of rim gear 109 while at the zero and 180 degree positions. Consequently, while at the 270 degree position shown in FIG. 14, offset distance 101 will be zero. Rotating rim gear 109 an incremental distance b relative to power gear 107 places link pin 105 at an offset distance 101 from the longitudinal axis 111 of the cylinder, increasing torque.

FIGS. 14 and 15 illustrate that the stroke can be varied between maximum and minimum positions even if the link pin 105 travels along a straight linear path rather than an elliptical path as shown in FIGS. 12 and 13. In FIGS. 14 and 15, link pin 105 will travel along a linear path whether it is located in the maximum stroke position or the minimum position. In the minimum stroke position, the linear path would be along a 90–270° line relative to axis 111 of the cylinder. In the position of FIG. 15, the linear path will be generally along a 130–110° line as power gear 107 orbits around rim gear 109.

The invention has significant advantages. In the embodiment that constrains the rod to move along the axis of the cylinder, both ends of the cylinder can be utilized as working fluid chambers. Both the inner and outer chambers can be utilized as a pump. In the context of an engine, one working fluid chamber can be a combustion chamber, while the other can be a pre-compression chamber. This allows super charging the engine. Alternately, both chambers can be combustion chambers, each having intakes and exhausts.

In the embodiments that do not constrain the piston rod to move along the axis of the cylinder, the stroke can be readily varied. Rotating the rim gear to different positions adjusts the stroke between maximum and minimum positions. The internal rim gear can be allowed to move as load or demand increases. The elliptical path allows one to vary the speed of the piston at various points along the stroke.

While the invention has been shown in only a few of its forms, it should be apparent to those skilled in the art that it is not limited but it is susceptible to various changes without departing from the scope of the invention. For example, only one piston and cylinder could be employed, rather than two.

I claim:

1. A drive apparatus, comprising:

a piston slidably carried in a cylinder for stroking reciprocally along an axis of the cylinder;

a piston rod having a first end connected to the piston and a second end;

a power gear concentrically mounted to a power gear shaft;

a link pin connected between the second end of the piston rod and the power gear at a point offset from the power gear shaft, wherein as the second end of the rod strokes, the power gear rotates;

a rim gear having teeth on an inner diameter that mesh with teeth on the power gear causing the power gear to orbit within the rim gear as the power gear rotates while the rim gear is stationary, the rim gear having a center point that is on the axis of the cylinder, the rim gear having a pitch diameter that is a multiple of a pitch diameter of the power gear;

a crankshaft gear concentrically mounted to a primary shaft for rotation therewith, the power gear shaft engaging the crankshaft gear at a point offset from the primary shaft, wherein as the power gear orbits within the rim gear, the crankshaft gear and primary shaft rotate;

wherein the link pin has an axis that is located between the power gear shaft and a pitch diameter of the power gear, tracing an elliptical path as the power gear orbits about the rim gear;

the rim gear being rotatable toward a maximum stroke length position that positions the axis of the link pin farthest from the center point of the rim gear while on the axis of the cylinder and toward a minimum stroke length position located rotationally 90 degrees from the maximum stroke length position;

a spring that urges the rim gear to the maximum stroke length position; and an actuator connected with the spring that moves the spring in response to a load being applied to the piston.

2. A drive apparatus, comprising:

a piston slidably carried in a cylinder for stroking reciprocally along an axis of the cylinder;

a piston rod having a first end connected to the piston and a second end;

a power gear concentrically mounted to a power gear shaft;

a link pin connected between the second end of the piston rod and the power gear at a point offset from the power gear shaft, wherein as the second end of the rod strokes, the power gear rotates;

a rim gear having teeth on an inner diameter that mesh with teeth on the power gear causing the power gear to orbit within the rim gear as the power gear rotates while the rim gear is stationary, the rim gear having a center point that is on the axis of the cylinder, the rim gear having a pitch diameter that is a multiple of a pitch diameter of the power gear;

a crankshaft gear concentrically mounted to a primary shaft for rotation therewith, the power gear shaft engaging the crankshaft gear at a point offset from the primary shaft, wherein as the power gear orbits within the rim gear, the crankshaft gear and primary shaft rotate;

wherein the link pin has an axis that is located between the power gear shaft and a pitch diameter of the power gear, tracing an elliptical path as the power gear orbits about the rim gear wherein the apparatus is a pump; and wherein:

the rim gear is rotatable toward a maximum stroke position which positions the axis of the link pin farthest from the center point of the rim gear while on the axis of the cylinder and toward a minimum stroke position located rotationally 90 degrees from the maximum stroke position; and the apparatus further comprises:

a spring that urges the rim gear to the maximum stroke position; and a fluid inlet and outlet in the cylinder, wherein as resistance to stroking of the piston increases, the rim gear will overcome the force of the spring and rotate toward the minimum stroke position.

3. A drive apparatus, comprising:

a piston slidably carried in a cylinder for stroking reciprocally along an axis of the cylinder;

a piston rod having a first end connected to the piston and a second end;

a power gear concentrically mounted to a power gear shaft;

a link pin connected between the second end of the piston rod and the power gear at a point offset from the power gear shaft, wherein as the second end of the rod strokes, the power gear rotates;

a rim gear having teeth on an inner diameter that mesh with teeth on the power gear, causing the power gear to orbit within the rim gear as the power gear rotates while the rim gear is stationary, the rim gear having a center point that is on the axis of the cylinder, the rim gear having a pitch diameter that is a multiple of a pitch gear of the power gear;

the rim gear being rotatable to vary the position of the link pin relative to the axis of the cylinder while the link pin is at its maximum and minimum distances from the center point of the rim gear, thereby varying the length of the stroke of the piston;

an actuator assembly that biases the rim gear to a maximum stroke length position and rotates the rim gear in response to a load applied to the piston; and wherein the link pin has an axis that is located between the power gear shaft and a pitch diameter of the power gear, tracing an elliptical path as the power gear orbits within the rim gear.

4. A drive apparatus, comprising:

a piston slidably carried in a cylinder for stroking reciprocally along an axis of the cylinder;

a piston rod having a first end connected to the piston and a second end;

a power gear concentrically mounted to a power gear shaft;

a link pin connected between the second end of the piston rod and the power gear at a point offset from the power gear shaft, wherein as the second end of the rod strokes, the power gear rotates;

a rim gear having teeth on an inner diameter that mesh with teeth on the power gear, causing the power gear to orbit within the rim gear as the power gear rotates while the rim gear is stationary, the rim gear having a center point that is on the axis of the cylinder, the rim gear having a pitch diameter that is a multiple of a pitch gear of the power gear;

the rim gear being rotatable to vary the position of the link pin relative to the axis of the cylinder while the link pin is at its maximum and minimum distances from the center point of the rim gear, thereby varying the length of the stroke of the piston;

wherein the link pin has an axis that is located between the power gear shaft and a pitch diameter of the power gear, tracing an elliptical path as the power gear orbits within the rim gear; and a spring connected to the rim gear to urge the rim gear to rotate to a position of maximum length stroke of the piston.

5. A drive apparatus, comprising:

a piston slidably carried in a cylinder for stroking reciprocally along an axis of the cylinder;

a piston rod having a first end connected to the piston and a second end;

a power gear concentrically mounted to a power gear shaft;

a link pin connected between the second end of the piston rod and the power gear at a point offset from the power gear shaft, wherein as the second end of the rod strokes, the power gear rotates;

a rim gear having teeth on an inner diameter that mesh with teeth on the power gear, causing the power gear to orbit within the rim gear as the power gear rotates while the rim gear is stationary, the rim gear having a center point that is on the axis of the cylinder, the rim gear having a pitch diameter that is a multiple of a pitch gear of the power gear;

the rim gear being rotatable to vary the position of the link pin relative to the axis of the cylinder while the link pin is at its maximum and minimum distances from the center point of the rim gear, thereby varying the length of the stroke of the piston;

wherein the link pin has an axis that is located between the power gear shaft and a pitch diameter of the power gear, tracing an elliptical path as the power gear orbits within the rim gear; and wherein the apparatus comprises a pump and further comprises: an actuator that senses pressure of fluid being pumped by the pump and causes the rim gear to rotate toward a minimum stroke position as the pressure of the fluid being pumped increases.

* * * * *